United States Patent [19]

Massarsky

[11] 4,267,029

[45] May 12, 1981

[54] ANODE FOR HIGH RESISTIVITY CATHODIC PROTECTION SYSTEMS

[75] Inventor: Philip M. Massarsky, Warren, N.J.

[73] Assignee: Pennwalt Corporation, Philadelphia, Pa.

[21] Appl. No.: 109,959

[22] Filed: Jan. 7, 1980

[51] Int. Cl.[3] ..... C23F 13/00

[52] U.S. Cl. ..... 204/196; 204/290 F

[58] Field of Search ..... 204/147, 196, 290 F

[56] References Cited

U.S. PATENT DOCUMENTS

| | | | |
|---|---|---|---|
| 2,851,413 | 9/1958 | Hosford | 204/196 |
| 3,038,849 | 6/1962 | Preiser | 204/196 |
| 3,060,259 | 10/1962 | Flower et al. | 204/196 |
| 3,313,721 | 4/1967 | Teel | 204/290 F |
| 3,425,921 | 2/1969 | Sudrabin | 204/196 |
| 3,527,685 | 9/1970 | Anderson | 204/196 |
| 3,616,354 | 10/1971 | Russell | 204/290 F |
| 3,616,418 | 10/1971 | Anderson et al. | 204/196 |
| 3,684,680 | 8/1972 | Heuze | 204/196 |
| 3,880,721 | 4/1975 | Littauer | 204/196 |
| 3,954,591 | 5/1976 | Conkling | 204/196 |
| 4,091,291 | 5/1978 | Foster et al. | 204/196 |
| 4,170,532 | 10/1979 | Tatum | 204/196 |
| 4,187,164 | 2/1980 | Warne | 204/196 |

FOREIGN PATENT DOCUMENTS

| | | | |
|---|---|---|---|
| 1110983 | 7/1961 | Fed. Rep. of Germany | 204/196 |
| 1224114 | 9/1966 | Fed. Rep. of Germany | 204/196 |
| 2408392 | 8/1974 | Fed. Rep. of Germany | 204/290 F |
| 2617639 | 11/1977 | Fed. Rep. of Germany . | |
| 896912 | 5/1962 | United Kingdom | 204/290 F |
| 1387991 | 3/1973 | United Kingdom . | |

OTHER PUBLICATIONS

Texas Instruments Publication 491.

"Proc. of Symposium-Cathodic Protection-London, May 1975", sponsored by IMI Marston Limited, Wolverhampton, England, pp. 1-79.

*Primary Examiner*—T. Tung

*Attorney, Agent, or Firm*—Edward A. Sager

[57] ABSTRACT

An improved anode is disclosed for high resistivity, cathodic protection systems in which D. C. current is impressed from the anode. The anode includes a cable comprising a conductor with an insulating jacket, with a mesh or expanded metal sheet of platinum - clad - niobium formed about and gripping the insulating jacket. The platinized mesh is electrically connected to the conductor at an enclosed terminal along the length of the cable.

3 Claims, 5 Drawing Figures

ANODE FOR HIGH RESISTIVITY CATHODIC PROTECTION SYSTEMS

BACKGROUND OF THE INVENTION

This invention relates to an improved anode for cathodic protection systems. Such anodes are frequently used to protect metal water tanks from corrosion, and in other high resistivity applications. Potable water and other material in contact with the anode having a resistivity of at least 1000 ohm-centimeters, are considered high resistivity applications.

Cathodic protection systems of the type set forth also have means for supplying D.C. current to the anode and then to the tank.

The various anodes currently used in cathodic protection systems may be in the form of wire, ribbon, or expanded metal or mesh. Each may have a thin coating of platinum electroplated or clad to a substrate of titanium, tantalum or niobium. For the present invention, a niobium substrate is preferred. The niobium substrate is strong, durable, and highly resistant to consumption by electro-chemical action in water, and the platinum coating provides long life and economy.

Expanded metal or mesh type of anode materials noted above have seen limited use in cathodic protection systems because as supplied they are fragile, and they are also difficult to handle without snagging or cutting other objects. The present invention overcomes such problems with commercially available anode mesh material, and it provides a simple inexpensive and novel anode construction which is highly effective and durable in use.

PRIOR ART

Cathodic protection systems of the general type set forth are shown in U.S. Pat. Nos. 3,954,591 to Conkling and 3,425,921 to Sudrabin.

It is known to provide a platinum coating clad to an object of niobium or other metal for cathodic protection systems, for example as shown in U.S. Pat. Nos. 3,038,849; 3,313,721; 3,684,680; 3,880,721; and 4,170,532, also Texas Instruments Incorporated publication 491 entitled "Connection for Impressed Current Cathodic Protection Anodes." However, the constructions disclosed in these references are unlike the anode construction of the present invention.

It is also known from U.K. Patent Specification No. 1,387,991 and German DT-OS No. 26 17 639 to protect the exterior of the cable against injury with an outer protective mesh of expanded metal, although these citations do not relate to anode constructions or cathodic protection systems.

Additional prior art noted herein in U.S. Pat. No. 3,060,259 which shows an anode externally attached to a continuous conductor, wherein the anode is of silicon iron material and not an expanded metal construction. U.S. Pat. No. 4,091,291 bears a superficial resemblance to the present invention; however, it is a sacrificial anode of aluminum alloy material which apparently operates by galvanic action rather than an impressed D.C. current. Furthermore, it is used to protect the exposed neutral conductor of an underground A.C. power cable rather than a tank.

From the above cited art, it appears that platinum-clad-niobium mesh anodes have been employed previously in cathodic protection systems, but that the particular applications and anode constructions disclosed therein are quite different from those of the present invention. It also appears that steel mesh has been formed about cable to protect its surface from damage but not as part of an anode. Other prior art bearing a superficial resemblance to the present invention is constructed upon a fundamentally different plan, as noted above.

BRIEF STATEMENT OF THE INVENTION

According to the present invention, an improved anode is provided for a high resistivity, impressed D.C. current, cathodic protection system, such as for protecting a metal tank situated above ground and containing potable water.

The improved anode comprises a cable including an elongated electrical conductor, jacketed for its length with electrical insulation, and having a sheet of expanded metal formed about and gripping the insulation of the conductor. The expanded metal sheet provides an anode with relatively low electrical resistance to the electrolyte, i.e. the water in the tank, than does an anode of solid form, such as a wire or ribbon. Furthermore, an anode of expanded metal contains less material than an anode of solid form. Thus, an anode of expanded metal not only conserves material, its low electrical resistance to electrolyte also conserves electrical energy.

The niobium substrate is strong, bendable, and resistant to deterioration under electro-chemical activity in water. Furthermore, the platinum cladding is a stable coating on one side of the substrate, and although it is slowly consumed by the electro-chemical process, the rate of platinum consumption is so slow that the anode is regarded as a long life, non-sacrificial anode.

It is well understood that the expansion of a ribbon anode into a mesh anode reduces the amount of material used for a given length of anode, but the substantial reduction in resistance to electrolyte is unexpected. A 3:1 expansion of a given ribbon presents about the same broad surface area to the electrolyte when it becomes a mesh; however, a ribbon expanded to three times its original length to a mesh has only about one half its original resistance. Therefore, the energy required to operate a cathodic protection system may be reduced substantially.

The formation of the platinized mesh into an outer member of C-shaped cross section, secured to and carried by the insulated conductor, is a significant distinction from prior art anodes and it has a number of advantages. First, it curves the sharp edges of the expanded metal sheet inwardly toward one another, thus making it easier to handle without cutting or snagging surrounding objects. Secondly, the insulated conductor provides strong support for the fragile mesh, and they may be secured together with simple and inexpensive ties, yielding a strong, durable and flexible anode. Third, electrical connection of the mesh to the conductor is made simply, inexpensively, and effectively at enclosed terminals along the length of the cable; and such terminals are made waterproof by filling the enclosure with epoxy material. Fourth, it has been found that anode constructions as described having their platinized surface facing outwardly are about 3 to 5% more energy efficient than flat mesh anodes, apparently because neighboring lines of flux offer less interference to one another when they are outwardly divergent rather than parallel.

BRIEF DESCRIPTION OF THE DRAWINGS

In the drawings:

FIG. 2 is a plan view of a cable embodying the anode of the present invention and having a weight appended to an end there of;

FIG. 3 is a transverse cross-sectional view, taken along line 3—3 of FIG. 2, showing details of the cable on a large scale;

FIG. 5 is a plan view of the expanded metal portion of the anode of FIG. 2, but on a larger scale.

DESCRIPTION OF THE PREFERRED EMBODIMENT

Figure 1:
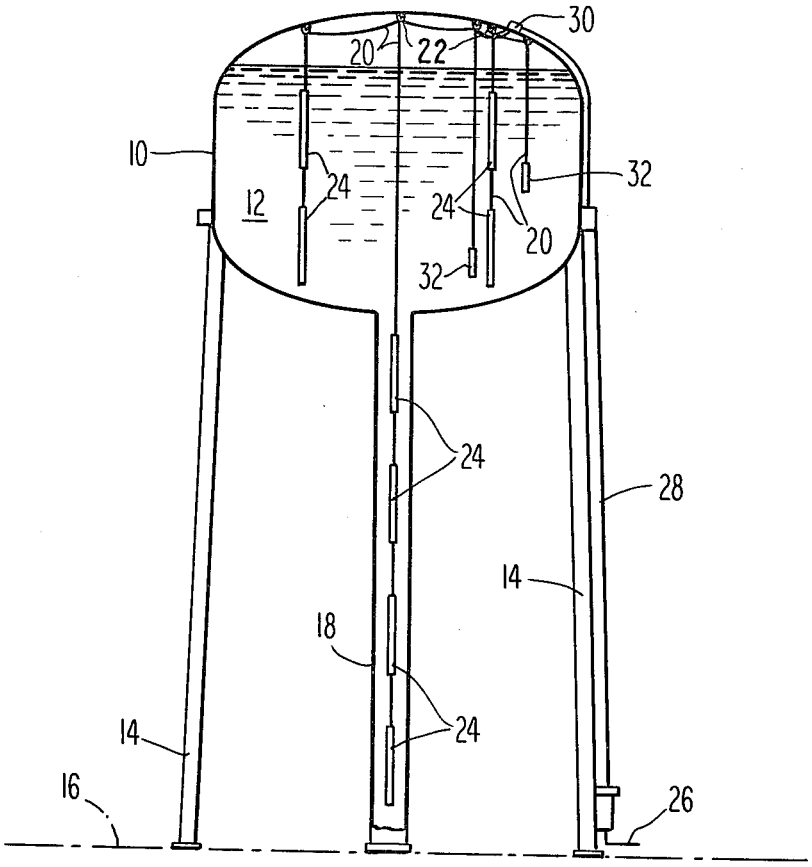
FIG. 1 is an elevational view of an above ground water tank to which the invention, shown schematically, is applied.

As shown in FIG. 1, the invention is applied to an above-ground storage tank 10 containing a body of potable water 12. It has supporting legs 14 resting on the ground 16 and a tubular riser 18. Cables 20 are suspended from the top of the tank by supports 22, and the anodes of the present invention are designated by the numeral 24.

The electrical system comprises a power input line 26, a conduit 28, a conduit entrance 30, and reference electrodes 32.

Figures 2, 3, 5:
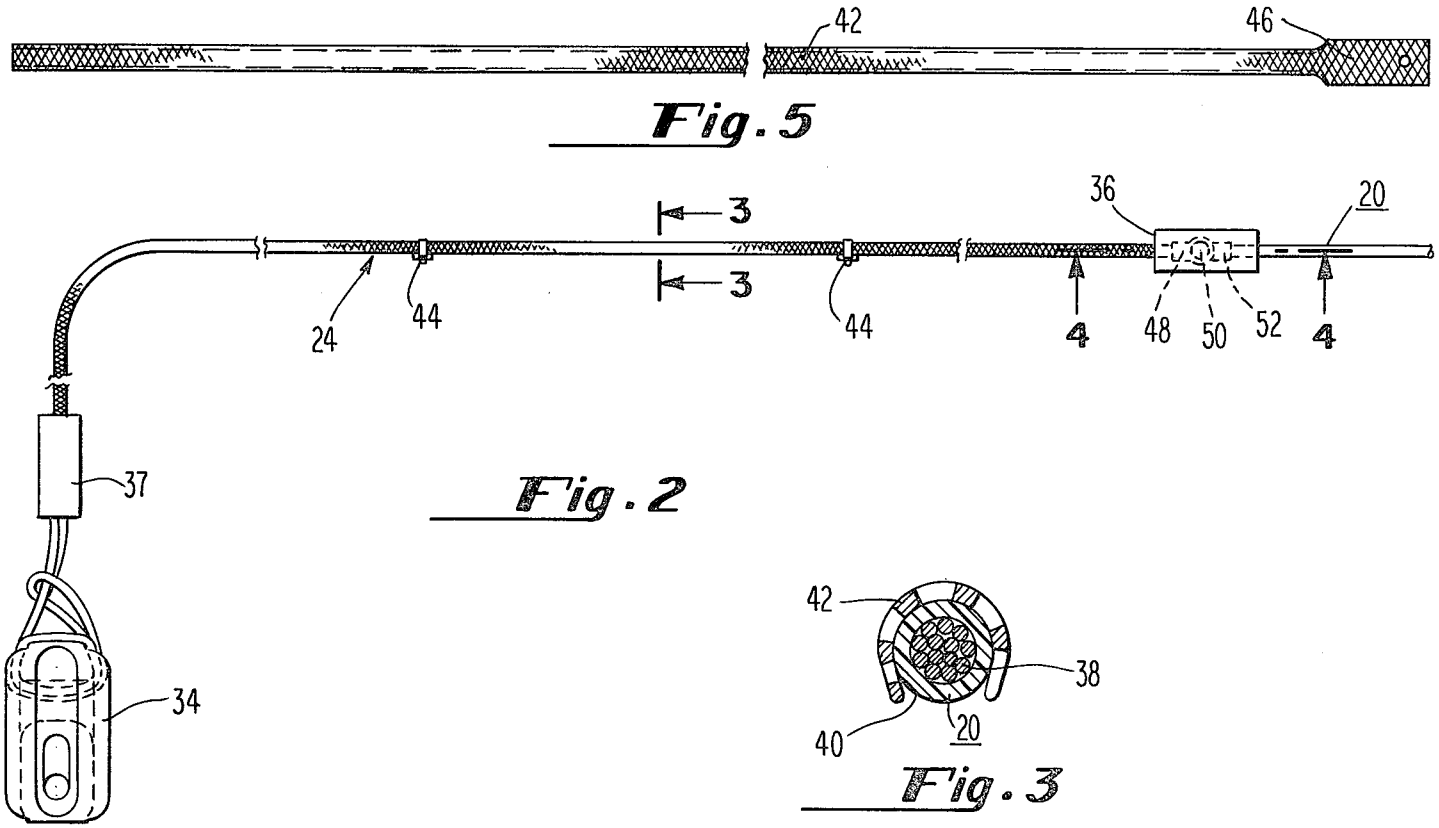

Referring now to FIG. 2, each assembled anode 24 comprises the cable generally designated 20 having a weight 34 at its lower end and terminal housings 36, 37 at spaced intervals along its length. The weight 34 may be a ceramic insulator suitably tied to the assembly.

As best seen in FIG. 3, the cable 20 includes an elongated electrical conductor 38 comprising stranded copper wire and an electrical insulation jacket 40 for substantially its entire length. The electrical conductor 38 not only conducts D.C. current, it also carries the mesh or expanded metal sheet 42 of anode material. The sheet 42 is arcuately formed about the cable 20 into a generally C-shaped cross section, and the sheet extends along a substantial part of its length from a terminal housing 36. The anode sheet 42 grips the insulation jacket 40, however plastic ties 44 are employed at frequently spaced intervals to further secure the sheet 42 to the outside of the insulation jacket 40. By this construction, a sturdy, flexible and durable anode assembly is made.

Reference may be made to FIG. 5 for further detail concerning the construction of the anode sheet 42 prior to its assembly with the cable 20. Of particular note is the end portion 46 providing a terminal for making an electrical connection to the conductor 38.

The anode sheet 42 can be perforated metal or mesh, but a 3:1 expanded metal sheet is preferred. By this is meant that a ribbon may be appropriately cut and then stretched to three times its original length to provide an elongated member of openwork construction. As stated previously, such anode sheet 42 is preferably a niobium substrate, although tantalum and titanium substrates may be substituted in certain applications. The niobium substrate is provided with a platinum clad coating on the outwardly facing side thereof.

For proper operation of the anode its electro-chemical activity operates by contact with the water or other electrolyte in the tank, to the exclusion of the conductor 38. In order to keep the conductor 38 out of electrolytic contact with the water, it is sealed by its insulation jacket 40 and the terminal housings 36.

Figure 4:
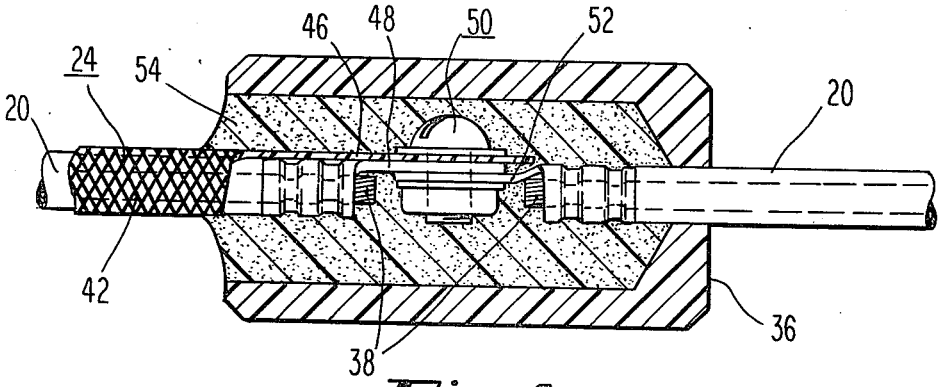
FIG. 4 is an enlarged cross-sectional view, taken longitudinally of the cable along line 4—4 of FIG. 2, showing an electrical terminal and its housing in detail.

The waterproof construction of the housing 36 is best seen in FIG. 4 where a cable 20 is joined to an anode 24. As shown on the left in FIG. 4, an electrical connection is first provided between its anode sheet 42 and its conductor 38 by contact between the end portion 46 and a ring terminal 48 crimped to the end of the conductor 38. Such contact is firmly screwed by a nut, bolt and washer assembly 50 disposed centrally of the housing 36. Another ring terminal 52, crimped to the conductor 38 of the cable 20 on the right in FIG. 4, is also connected by assembly 50. With this arrangement, D.C. current delivered by cable 20 may be impressed from the anode 24. The entire assembly of FIG. 4 is made waterproof by filling the interior of the housing 36 with epoxy cement 54. The construction of FIG. 4 permits a plurality of electrical elements to be connected together end to end at the adjacent ends of anode sheets 42 and conductors 38.

A comparison of the anode of the present invention may be made with prior art anodes through the following examples, all being platinum coated niobium.

EXAMPLE I

A solid ribbon anode 7 inches long and 0.5 inches wide presented one broad platinized surface of 3.5 square inches at a resistance of 160 ohms. If expanded to 20.5 inches in length a surface of 3.4 square inches is presented to the electrolyte at 81 ohms.

EXAMPLE II

In this example expanded metal 0.5 inches wide is compared with solid wire anode material of 0.100 diameter, both 19⅜" inches long. The wire has a larger surface area of 6.09 square inches, compared to 3.23 square inches for the expanded metal, but the former has 128 ohms resistance and the latter has 109 ohms resistance. Moreover, the wire requires 11.29 grams of material compared to 6.85 grams for the expanded metal.

From the foregoing it can be seen that the present invention provides a strong, flexible, durable, non-sacrificial anode construction for high resistivity cathodic protection systems, which conserves material and energy.

What is claimed is:

1. In an impressed D.C. current cathodic protection system for protecting a metal water tank or the like from rust corrosion effects of an electrolytic material having a resistivity of at least 1000 ohm-centimeters, said system having suspension means suspending an improved anode within said tank, said anode comprising:

(a) a cable including (b) an elongated electrical conductor connected to said source of D.C. current, and (c) a jacket of electrical insulation on the outside of said conductor for substantially the length thereof, operative to seal said conductor from the electrolytic material in said tank;

(d) a sheet of expanded metal gripping said jacket of generally arcuate cross-section formed about said cable and extending along said cable, said sheet comprising (e) a substrate made of a first metal from the group consisting of niobium, tantalum and titanium, and (f) a coating of platinum clad to the outwardly facing surface of said substrate; and (g) a terminal providing an electrical connection between said electrical conductor and said sheet and including a housing enclosing said electrical connection.

2. In a cathodic protection system, an anode according to claim 1 wherein said sheet is of expanded metal construction in the expansion ratio of 3 to 1.

3. In a cathodic protection system according to claim 1 having a plurality of anodes connected together wherein adjacent ends are connected together by providing an electrical connection of the respective adjoining ends of said sheets and said conductors within the housing of a common terminal.

* * * * *